US005150157A

United States Patent [19]

Yamaki

[11] Patent Number: 5,150,157

[45] Date of Patent: Sep. 22, 1992

[54] ELECTROPHOTOGRAPHIC APPARATUS

[75] Inventor: Yuichi Yamaki, Hitachi, Japan

[73] Assignee: Hitachi, Ltd., Tokyo, Japan

[21] Appl. No.: 543,446

[22] Filed: Jun. 26, 1990

[30] Foreign Application Priority Data

Jun. 28, 1989 [JP] Japan ..... 1-164030

[51] Int. Cl.[5] ..... G03G 5/02; G03G 21/00

[52] U.S. Cl. ..... 355/219; 355/210; 361/220

[58] Field of Search ..... 355/219, 220, 211, 221, 355/225, 218; 361/225, 220, 223, 224; 430/902

[56] References Cited

U.S. PATENT DOCUMENTS

| | | | |
|---|---|---|---|
| 2,833,930 | 5/1958 | Walkup | 430/902 X |
| 3,272,626 | 9/1966 | Shinn | 430/902 X |
| 3,373,019 | 3/1968 | Bixby | 355/210 X |
| 4,450,220 | 5/1984 | Haneda et al. | 430/902 X |
| 4,589,053 | 5/1986 | Hosono et al. | 361/220 X |
| 4,700,261 | 10/1987 | Nagase et al. | 361/225 |
| 4,709,298 | 11/1987 | Hosono et al. | 361/225 X |
| 4,785,372 | 11/1988 | Hosono et al. | 361/225 |

FOREIGN PATENT DOCUMENTS

| | | | |
|---|---|---|---|
| 0195564 | 10/1985 | Japan | 355/219 |
| 0017165 | 1/1986 | Japan | 355/219 |
| 0027568 | 2/1986 | Japan | 355/219 |
| 0292358 | 11/1989 | Japan | 355/219 |

OTHER PUBLICATIONS

"Base and Application of Electrophotographic Technique" distributed on Jun. 15, 1988 by Corona Publishing Co., Japan.

*Primary Examiner*—A. T. Grimley
*Assistant Examiner*—Matthew S. Smith
*Attorney, Agent, or Firm*—Antonelli, Terry, Stout & Kraus

[57] ABSTRACT

A conductive plate is separated from a rotary drum type photosensitive member so that the plate and the member are not in contact. A DC constant voltage which is greater than 2000 volts and less than 3000 volts is applied between the conductive plate and the rotary drum type photosensitive member is a dark chamber. As a result, an electric charge is attached uniformly on the surface of the rotary drum type photosensitive member. The rotary drum type photosensitive member, which has the uniform electric charge on the surface thereof, is exposed by a laser and developed by a development counter, and an image on the rotary drum type photosensitive member is transferred to a paper by a transfer unit. An erase lamp erases the surface potential of the rotary drum type photosensitive member.

5 Claims, 1 Drawing Sheet

ELECTROPHOTOGRAPHIC APPARATUS

FIELD OF THE INVENTION

The present invention relates to an electrophotographic apparatus such as a laser printer, a duplicator, a facsimile.

BACKGROUND OF THE INVENTION

There are two kinds of charging methods in an electrophotographic apparatus such as a laser printer, a duplicator, and a facsimile. One of the charging methods is a corona charging method which attaches ions or electrons, without contacting, to an outer peripheral surface of a rotary drum type photosensitive member, as disclosed, for instance, in FIG. 2.4 from pages 48 to 53 of "Base and Application of Electrophotographic Technique" published on Jun. 15, 1988 by Corona Co. in Japan. The other method is a contacting type conductive brush charging method, as disclosed, for instance, in FIG. 2.8 of the above-mentioned "Base and Application of Electrophotographic Technology".

Further, a development counter having charge electrodes is disclosed, for instance, in U.S. Pat. No. 4,450,220 issued on May 22, 1984 and entitled "Method of charging electrostatic developer". Referring to FIGS. 7 and 8 of U.S. Pat. No. 4,450,220, they disclose that the toner powder is applied to the charging space formed between the charging member and the sleeve and then the electrostatic image developed on the sleeve is transferred to the rotary drum type photosensitive member.

The contactless type corona charging method, as in the conventional electrophotographic apparatus mentioned above, has the following drawback. When ions or electrons are attached on the surface of the rotary drum type photosensitive member, the performance and durability of the photosensitive member are remarkably deteriorated and the quality of print is affected adversely, since the photosensitive member is affected by ozone or corona ions generated at the corona discharge. An ozone filter, which is made up of an activated carbon and a strong fan, have to be supplied for removing the generated ozone, which has strong offensive odor, and exhausting the ozone. Since high voltage of 3000–4000 volts has to be provided for the charging corona, there are problems of environmental sanitation, high power demand, and danger of receiving an electric shock. The contacting type conductive brush charging method mentioned above has a drawback that the surface of the rotary drum type photosensitive member is worn out.

The development counter having charge electrodes mentioned above is different from the electrophotographic apparatus of the present invention in its principle of operation, as is apparent from the explanation below.

SUMMARY OF THE INVENTION

An object of the present invention is to provide an electrophotographic apparatus using a contactless electrifier, which does not generate corona discharge and does not wear out the surface of the rotary drum type photosensitive member.

For attaining the object mentioned above, the present invention is characterized in that a conductive plate is positioned apart from a the surface of a rotary drum type photosensitive member in such a manner that the plate and drum are not in contact, a DC constant voltage, which is greater than 2000 volts and less than 3000 volts is supplied between the conductive plate and the rotary drum type photosensitive member in a dark room, and the area of the conductive plate is large comparatively. Concretely, the width of the conductive plate is larger than the diameter of the rotary drum type photosensitive member.

When a dielectric is used on the surface of a rotary drum type photosensitive member for generating an electric field in an air gap between the conductive plate and the rotary drum type photosensitive member, the rotary drum type photosensitive member has to be formed in two layers of a cylindrical conductor and a photosensitive layer.

One feature of the present invention is to use the conductive plate instead of an electrode of the conventional electrophotographic apparatus which generates the corona discharge using a needle, wire or edge type electrode. Another feature of the present invention is that the applied voltage between the conductive plate and the rotary drum type photosensitive member is greater than 2000 volts and less than 3000 volts. When the applied voltage is higher than 3000 volts, corona is generated, and when the applied voltage is lower than 2000 volts, the electric field generated at the air gap is small so that the duplication provided by this apparatus is not well done.

An electric charge quantity Q which is attached to the photosensitive member is shown as follows:

$$Q = CV \tag{1}$$

C: electrostatic capacity

V: applied voltage where, C is shown as follows:

$$C = \frac{\epsilon_o \epsilon_1 S}{d_1 + \epsilon_1 d_o} \tag{2}$$

$\epsilon_o$: dielectric constant of air $\epsilon_l$: dielectricconstant of the photosensitive member S: area of the conductive plate $d_l$: thickness of the photosensitive member $d_o$: distance between the conductive plate and the photosensitive member When the area S of the conductive plate is large and the distance $d_o$ between the conductive plate and the photosensitive member is small, the electrostatic capacity C becomes large. Accordingly, when the electric charge quantity Q on the surface of the rotary drum type photosensitive member is uniform over the surface thereof, the applied voltage may be small. The electric field strength E of the rotary drum type photosensitive member is as follows:

$$E = V/(d_o + d_l) \tag{3}$$

When the deviation $\Delta V$ of the applied voltage V and the deviation $\Delta d_o$ of the distance do are in the condition shown in the following equation (4), the electric field strength E becomes small so that the electric breakdown of the photosensitive member hardly occurs, $$\Delta V >> \Delta d_o \tag{4}$$

When the conductive plate is separated from the rotary drum type photosensitive member to the degree that they are not in contact and the DC constant voltage is applied between the conductive plate and the rotary drum type photosensitive member in a dark chamber, an electric field is generated between the conductive plate and the rotary drum type photosensitive member, based on the principle of a condenser, so that the electric charge is attached on the surface of the rotary drum type photosensitive member. When the area of the conductive plate is large, the DC constant voltage applied can be small, as is apparent from equation (1), and electric breakdown does not readily occur.

DETAILED DESCRIPTION OF THE PREFERRED EMBODIMENTS

Figure 1:
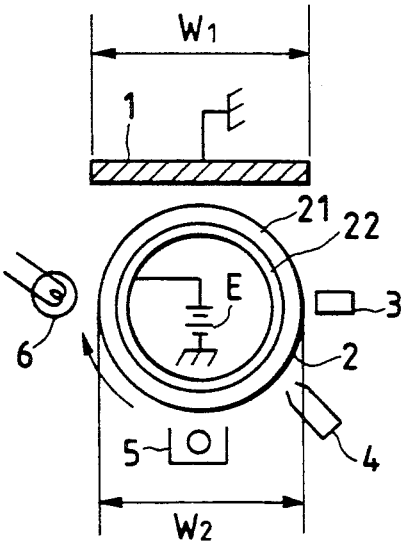
FIG. 1 illustrates one embodiment of the present invention in which the conductive plate is plain.
Figure 2:
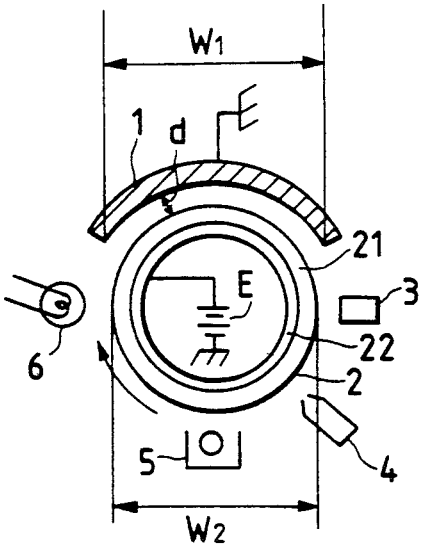
FIG. 2 illustrates another embodiment of the present invention in which the conductive plate is arcuate.

Referring to FIGS. 1 and 2, a conductive plate 1 and a rotary drum type photosensitive member 2 face each other across an air gap. The rotary drum type photosensitive member 2 is formed in such a manner that the photosensitive layer 21, made of, for instance, an organic photoconductor, selenium, or amorphous silicon, is formed on the cylindrical conductor 22 made of, for instance, aluminum, by dipping the cylindrical conductor 22 in a solution of the photosensitive material. The conductor 22 is connected to the positive electrode of a DC constant voltage source E, which is greater than 2000 volts and less than 3000 volts. The conductive plate 1 is grounded. It is possible that the conductor 22 is grounded and the conductive plate 1 is connected to the positive electrode of DC constant voltage which is greater than 2000 volts and less than 3000 volts. The rotary drum type photosensitive member 2 is rotated in the direction shown by the arrow. The conductive plate 1 is arranged in the rotational direction of the rotary drum type photosensitive member 2. There is a relation of $W_1 > W_2$, when the width of the conductive plate 1, where $W_2$ is measured along the rotational direction of the rotary drum type photosensitive member 2, and $W_2$ is the diameter of the rotary drum type photosensitive member 2. Further, there is a relation of $L_1 > L_2$, where $L_1$ is the longitudinal length of the conductive plate 1 and $L_2$ is the axial length of the rotary drum type photosensitive member.

Figure 3:
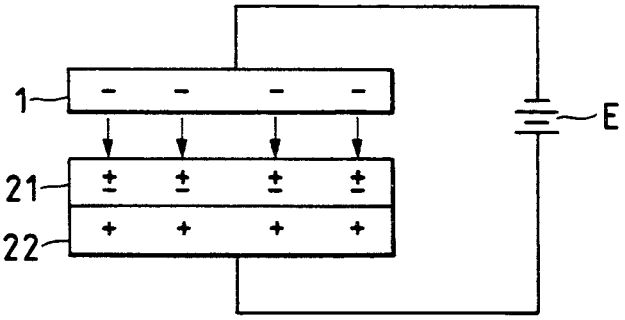
FIG. 3 is a diagram useful for explaining the operation of the rotary drum type photosensitive member and the conductive plate; an FIG. 4 is a diagram depicting the conductive plate and the photosensitive member which is useful for explaining the dimensions of the conductive plate and the rotary drum type photosensitive member.
Figure 4:
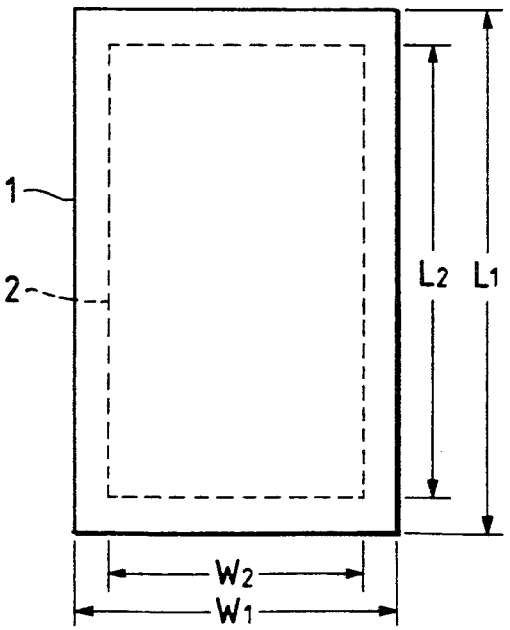

As shown in FIG. 3, the negative electric charge is applied to the conductive plate 1, and the positive charge is applied to the cylindrical conductor 22, when the conductive plate 1 is connected to the negative polarity and the conductor 22 is connected to the positive polarity of the battery E in a dark chamber. Consequently, an electric field is formed between the conductive plate 1 and the conductor 22, and electrostatic induction is caused in the photosensitive layer 21 since the photosensitive layer 21 is a dielectric, so that a negative charge is induced on the side of layer 21 adjacent conductor 22 and a positive charge is induced on the side of the photosensitive layer 21 adjacent conductive plate 1. Of course the conductive plate 1 and the cylindrical conductor 22 can be connected to the positive polarity and the negative polarity, respectively, for achieving the object of the present invention. It is preferable that the air gap d shown in FIG. 2 between the conductive plate 1 and the photosensitive layer 21, be 600–2000 μm. In FIG. 1, the air gap d is the shortest distance between the conductive plate 1 and the photsensitive layer 21. Further, it is more preferable that the air gap d be constant as shown in FIG. 2. The most preferable electric field strength which is formed at the air gap is $1 \times 10^6$ to $5 \times 10^6$ V/m. However, the air gap d and the most preferable electric field strength is varied depending on the air pressure as defined by well-known Paschen's curve. The rotary drum type photosensitive member 2 is rotated in the clockwise direction, the photosensitive layer 21 is exposed to a desired image using the laser 3, the image exposed on the photosensitive member 21 is developed by the development counter 4, the developed image on the photosensitive layer 21 is duplicated on the paper using the transfer unit 5. Next, the surface potential on the rotary drum type photosensitive member is erased by the erase lamp 6. According to the structure shown by FIG. 2, the electric charge can be attached uniformly on the surface of the rotary drum type photosensitive member.

Since the apparatus of the present invention is a contactless type electrophotographic apparatus and does not discharge corona, the durability of the rotary drum type photosensitive member can be prolonged. Since the apparatus of the present invention does not apply the contacting type conductive brush charging method, the surface of the rotary drum type photosensitive member is not worn out so that the durability of the drum type photosensitive member is prolonged in this respect. By making the area of the conductive plate large, the DC constant voltage applied thereto can be made small. By making the applied DC constant voltage of the apparatus small, electric breakdown of the photosensitive layer is scarcely experienced.

What we claim is:

1. An electrophotographic apparatus comprising:

a rotary drum type photosensitive member including a cylindrical conductor and a photosensitive layer formed on the outer peripheral surface of said cylindrical conductor;

a conductive plate facing said photosensitive layer across an air gap and disposed to extend in the axial direction of said rotary drum type photosensitive member; and an electric power source for supplying a DC constant voltage between said photosensitive member and said conductive plate, for causing a uniform electric charge to be formed on the surface of said photsensitive layer;

wherein said photsensitive member is positioned to prevent exposure of said photosensitive layer to extraneous light, while permitting the surface of said photosensitive layer to be selectively discharged by a laser beam within the electrophotographic apparatus to expose an image on said photosensitive layer, and wherein the distance between said photosensitive layer and said conductive plate is constant, and the diameter of said rotary drum type photosensitive member is less than the width of said conductive plate as measured in the direction of rotation of said rotary drum type photosensitive member.

2. An electrophotographic apparatus comprising:

a rotary drum type photosensitive member including an aluminum drum and an organic photoconductive layer formed on the outer peripheral surface of said aluminum drum;

a conductive plate facing said photoconductive layer across an air gap and disposed to extend in the axial direction of said rotary drum type photosensitive member; and an electric power source for supplying a DC constant voltage between said aluminum drum and said conductive plate, for causing a uniform electric charge to be formed on the surface of said photoconductive layer;

wherein said photosensitive member is positioned to prevent exposure of said photoconductive layer to extraneous light, while permitting the surface of said photoconductive layer to be selectively discharged by a laser beam within the electrophotographic apparatus to expose an image on said photoconductive layer, and wherein the distance between said organic photoconductive layer and said conductive plate is constant, and the diameter of said rotary drum type photosensitive member is less than the width of said conductive plate as measured in the direction of rotation of said rotary drum type photosensitive member.

3. An electrophotographic apparatus comprising:

a rotary drum type photosensitive member including an aluminum drum and a selenium layer formed on the outer peripheral surface of said aluminum drum;

a conductive plate facing said selenium layer across an air gap and disposed to extend in the axial direction of said rotary drum type photosensitive member; and an electric power source for supplying a DC constant voltage between said aluminum drum and said conductive plate, for causing a uniform electric charge to be formed on the surface of said selenium layer;

wherein said photosensitive member is positioned to prevent exposure of said selenium layer to extraneous light, while permitting the surface of said selenium layer to be selectively discharged by a laser beam within the electrophotographic apparatus to expose an image on said selenium layer, and wherein the distance between said selenium layer and said conductive plate is constant, and the diameter of said rotary drum type photosensitive member is less than the width of said conductive plate as measured in the direction of rotation of said rotary drum type photosensitive member.

4. An electrophotographic apparatus comprising:

a rotary drum type photosensitive member including an aluminum drum and an amorphous silicon layer formed on the outer peripheral surface of said aluminum drum;

a conductive plate facing said amorphous silicon layer across an air gap and disposed to extend in the axial direction of said rotary drum type photosensitive member; and an electric power source for supplying a DC constant voltage between said aluminum drum and said conductive plate, for causing a uniform electric charge to be formed on the surface of said amorphous silicon layer;

wherein said photosensitive member is positioned to prevent exposure of said amorphous silicon layer to extraneous light, while permitting the surface of said amorphous silicon layer to be selectively discharged by a laser beam within the electrophotographic apparatus to expose an image on said amorphous silicon layer, and wherein the distance between said amorphous silicon layer and said conductive plate is constant, and the diameter of said rotary drum type photosensitive member is less than the width of said conductive plate as measured in the direction of rotation of said rotary drum type photosensitive member.

5. An electrophotographic apparatus comprising:

a rotary drum type photosensitive member including a cylindrical conductor and a photosensitive layer formed on the outer peripheral surface of said cylindrical conductor;

a conductor plate facing said photosensitive layer across a constant air gap, the air gap being in the range of 600–2000 $\mu$m and disposed to extend in the axial direction of said rotary drum type photosensitive member, the conductive plate having a width as measured in the direction of rotation of said rotary drum type photosensitive member greater than the diameter of said rotary drum type photosensitive member and having a length as measured in the axial direction of said rotary drum type photosensitive member greater than the length of said rotary drum type photosensitive member as measured in the axial direction of said rotary drum type photosensitive member; and an electric power source for supplying a DC constant voltage between said photosensitive member and said conductive plate for causing an electric field in the range of $1\times10^6$ to $5\times10^6$ volts/m to be formed at the air gap;

wherein said photsensitive member is positioned to prevent exposure of said photosensitive layer to extraneous light when said photosensitive member is within the electrophotographic apparatus, while permitting the surface of said photosensitive layer to be selectively discharged by a laser beam within the electrophotographic apparatus to expose an image on said photosensitive layer.

* * * * *